US011679410B2

(12) United States Patent
Nilsson et al.

(10) Patent No.: US 11,679,410 B2
(45) Date of Patent: Jun. 20, 2023

(54) METHOD FOR COATING A TILE ELEMENT

(71) Applicant: SAINT-GOBAIN ECOPHON AB, Hyllinge (SE)

(72) Inventors: Thomas Nilsson, Helsingborg (SE); Roger Lovdahl, Glumslov (SE)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 228 days.

(21) Appl. No.: 17/256,448

(22) PCT Filed: Jul. 1, 2019

(86) PCT No.: PCT/EP2019/067568
§ 371 (c)(1),
(2) Date: Dec. 28, 2020

(87) PCT Pub. No.: WO2020/007782
PCT Pub. Date: Jan. 9, 2020

(65) Prior Publication Data

US 2021/0268539 A1 Sep. 2, 2021

(30) Foreign Application Priority Data

Jul. 6, 2018 (EP) ..... 18182178

(51) Int. Cl.
*B05D 1/26* (2006.01)
*B05C 5/02* (2006.01)
(Continued)

(52) U.S. Cl.
CPC ..... *B05D 1/26* (2013.01); *B05C 5/0204* (2013.01); *B05D 3/029* (2013.01); *B05D 3/0263* (2013.01);
(Continued)

(58) Field of Classification Search
CPC ..... B05D 1/26; B05D 5/0204; B05D 3/0263; B05D 3/029; B05D 3/0493; B05D 2401/20; B05D 2401/00; B05D 3/0254
See application file for complete search history.

(56) References Cited

U.S. PATENT DOCUMENTS 4,074,655 A 2/1978 Gross et al.
6,296,939 B1 * 10/2001 Kunze ..... B05D 7/06 427/325
(Continued)

FOREIGN PATENT DOCUMENTS

DE 29 19 723 A1 11/1979
EP 1 228 812 A1 8/2002
(Continued)

OTHER PUBLICATIONS

International Search Report dated Sep. 13, 2019 in PCT/EP2019/067568 filed Jul. 1, 2019.

*Primary Examiner* — Hai Y Zhang
(74) *Attorney, Agent, or Firm* — Oblon, McClelland, Maier & Neustadt, L.L.P.

(57) ABSTRACT

A method for coating a tile element includes providing a tile element made of a compressed fibre material having a porosity in the range of 0.92-0.99 and applying a water-based coating material to a side edge surface of the tile element extending between two opposite major surfaces of the tile element. The applying is performed by an applicator head of a continuous vacuum coating apparatus that applies the water-based coating material to the side edge surface of the tile element and removes excess through a vacuum. The water-based coating material is applied at a feeding rate of the tile element relative the applicator head in the range of 25-150 m/min. The water-based coating material forms a coating layer including an outer coating layer and an inner
(Continued)

coating layer penetrating the side edge surface. The inner coating layer has penetration depth of at least 100 μm.

13 Claims, 5 Drawing Sheets

(51) Int. Cl.
*B05D 3/02* (2006.01)
*B05D 3/04* (2006.01)

(52) U.S. Cl.
CPC ..... *B05D 3/0493* (2013.01); *B05D 2401/20* (2013.01)

(56) References Cited

U.S. PATENT DOCUMENTS

2007/0272481 A1 11/2007 Birch et al.
2015/0069150 A1* 3/2015 Huntzinger ..... B05C 5/0204 239/548

FOREIGN PATENT DOCUMENTS

EP 1228812 A1 * 8/2002 ..... B05C 1/006
WO WO 2005/095727 A1 10/2005

* cited by examiner

METHOD FOR COATING A TILE ELEMENT

FIELD OF THE INVENTION

The present invention relates to a method for coating a tile element, and more specifically to a method for coating a side edge surface of the tile element.

BACKGROUND ART

Tiles comprising compressed fibre material, such as glass or stone wool, may be arranged in a room or in another accommodation and may serve a variety of purposes. The tiles may for instance be used for improving the acoustical characteristics of the room or for concealing wiring, piping, as well as devices related to heating, ventilation, and air condition.

The tiles may form part of a tile system and may constitute horizontally arranged ceiling tiles, vertically arranged baffle elements, wall mounted elements or free standing screens.

A major surface of the tile may constitute a front surface intended to face the room in which the tile system is installed. The front surface may be provided with a front layer and is usually coated with a paint.

The side edge surfaces of the tile may also be coated.

Various techniques are used for the coating of the tile, and the side edge surfaces may for instance be coated by a roll coating apparatus or a spray coating apparatus.

Subsequently the coated tile may be subjected to a drying process, for instance in a heated drying oven.

SUMMARY OF THE INVENTION

In view of that stated above, the object of the present invention is to provide an improved method for coating a tile element made of a porous compressed fibre material.

It is also an object to provide such a method that speeds up the coating process while reducing the spillage.

A further object is to provide a method that allows utilization of a porous fibre material for the tile element having a high porosity.

To achieve at least one of the above objects, and also other objects that will be evident from the following description, a method having the features defined in claim 1 is provided according to the present invention. Preferred embodiments of the method will be evident from the dependent claims.

More specifically, there is provided according to a first aspect of the present invention a method for coating a tile element, comprising providing a tile element made of a compressed fibre material having a porosity in the range of 0.92-0.99, the tile element having two opposite major surfaces, and applying a water-based coating material to a side edge surface of the tile element extending between the two opposite major surfaces. The step of applying the water-based coating material is performed by means of an applicator head of a continuous vacuum coating apparatus, the applicator head being configured to apply the water-based coating material to the side edge surface of the tile element and to remove excess of the water-based coating material through a vacuum, wherein the water-based coating material is applied at a feeding rate of the tile element relative the continuous vacuum coating apparatus of at least 25 m/min and preferably in the range of 25-150 m/min. The water-based coating material is applied to the side edge surface such that a coating layer is formed comprising an outer coating layer extending beyond the side edge surface and an inner coating layer penetrating the side edge surface and extending into the tile element. The inner coating layer is given a penetration depth P1 of at least 100 μm and preferably in the range of 100-4000 μm.

By a continuous vacuum coating apparatus is in context with this application meant a coating apparatus of the type known for example from U.S. Pat. No. 5,298,078 or DE4021174 in which a flow of coating material is directed towards a workpiece and excess of the coating material is sucked back by means of a negative pressure or a vacuum.

Hereby an improved method for coating a tile element made of a porous compressed fibre material is provided.

The application of the water-based coating by means of the applicator head of a continuous vacuum coating apparatus ensures that spillage of the water-based coating material is minimized. This results in efficient utilization of resources and also in cost savings.

The relative feeding rate between the applicator head and the tile element of at least 25 m/min and preferably in the range of 25-150 m/min enables a high production rate and thus an efficient production. The applicator head may be stationary arranged and the tile element may be moved by means of a conveyor.

Also, the inventive method enables efficient application of the water-based coating material to side edge surfaces of tile elements made of a porous compressed fibre material having a high porosity, such as a compressed glass wool material having a density in the range of 25-200 kg/m$^3$. The possibility to use a fibre material having a high porosity may result in efficient utilization of resources since the weight of each tile element may be reduced, and also in improved acoustic performance of the tile element since a high porosity may improve the sound absorption properties of the tile element for certain frequencies.

Further, the inventive method may enable manufacturing of more esthetical pleasing tile elements since the occurrence of non-coated areas may be minimized as compared to conventional techniques such as spray coating or roll coating. The coating material may thus be applied with a relatively low wet surface density while providing a sufficient coverage of the side edge surface. Thus, the inventive method makes it possible apply the coating material to the side edge surface of the tile element with a sufficient coverage and with a low wet surface density.

Further, by applying the water-based coating material to the side edge surface by means of the applicator head of the continuous vacuum coating apparatus, a coating layer may be provided comprising an outer coating layer, corresponding to the part of the coating layer that extends beyond the side edge surface itself, and an inner coating layer, corresponding to the part of the coating layer that due to the application method and to the porosity of the fibre material making up the tile element penetrates the side edge surface and extends into the tile element.

The coating layer comprises an outer and an inner coating layer. Hereby it will be possible for the coating layer to add mechanical strength to the tile element even in the case the coating layer has a relatively low dry surface density.

By using a water-based coating material which after application and drying forms a coating layer with sufficient mechanical strength, it may be possible to subsequently form grooves and the like in the side edge surface of the tile element even if it is made of a compressed fibre material having a high porosity. The reason for this is that the inner coating layer may reinforce the side edge surface in which the grooves and the like is to be formed.

The mechanical strength of the coating layer formed by a specific water-based coating material is dependent on the porosity of the fibre material making up the tile element and the amount of applied coating material, i.e. the surface density of the applied coating material. It should be noted that a higher porosity may require a higher surface density to achieve a desired mechanical strength.

According to an embodiment of the present invention, the water-based coating material may be applied to all side edge surfaces extending between the two major surfaces of the tile element. By using a water-based coating material which after application and drying provides a sufficient mechanical strength of the coating layer, a reinforcing frame structure enclosing the tile element may be provided, also referred to as edge-banding. The reinforcing frame structure may enable using a fibre material of even higher porosity without having problems normally associated to high porosity, such as sagging. Also, a tile element having a coating layer on its side edge surfaces applied in accordance with the invention and forming a reinforcing frame will be easier to handle, for instance during installation.

According to another embodiment, the method may further comprise drying the applied water-based coating, for instance by means of IR-radiation or micro wave radiation. The drying may initially be assisted by exposure to steam, thereby ensuring a controlled drying process of the applied water-based coating material. Drying of the water-based coating material applied to the side edge surface of the tile element by means of IR-radiation and/or micro wave radiation may enable a fast drying process and may be performed during a period in the range of 8-45 s. Alternatively, the drying may be by means of hot air. IR-radiation and/or micro waves and/or hot air may also be used in combination.

According to yet another embodiment the outer coating layer may be given a thickness of at least 100 μm and may be in the range of 100-1500 μm According to yet another embodiment, the water-based coating material may be applied to the side edge surface with a wet surface density in the range of 300-1600 g/m$^2$. As mentioned above, the wet surface density for a specific coating material may be selected dependent on the porosity of the fibre material and the required mechanical strength of the coating layer. By "wet surface density" is meant the surface density of the applied coating layer as measured before drying of the coating material.

According to yet another embodiment, a water-based coating material is used having an operational viscosity in the range of 50-200 Krebs unit (KU) (about 0.15-11.27 kg/m/s), more preferably in the range of 80-160 KU (about 0.87-6.46 kg/m/s) and most preferably in the range of 105-115 KU (about 2.04-2.65 kg/m/s). By "operational viscosity" is meant the viscosity of the coating material during operation, i.e. when the coating material is circulated in the continuous vacuum coating apparatus. The viscosity can be measured using a viscometer of Stormer-type according to ASTM D562.

According to yet another embodiment, a water-based coating material is used having a dry content of at least 60 wt. % and may be in the range of 60-80 wt. %.

In accordance with an example, a tile element for a tile system may be provided, the tile element being made of a compressed fibre material having a porosity in the range of 0.92-0.99 and having two opposite major surfaces and side edge surfaces extending between the two opposite major surfaces. At least two opposing side edge surfaces are provided with a continuous vacuum coating apparatus applied coating layer, each coating layer comprising an outer coating layer extending beyond the associated side edge surface and an inner coating layer penetrating the associated side edge surface and extending into the tile element.

Hereby, an improved tile element is provided. By providing at least two opposing side edge surfaces with a coating layer having an outer coating layer and an inner coating layer, it will be possible of provide the at least two side edge surfaces with sufficient mechanical strength—even in the porosity of the tile element is high—enabling forming of grooves and the like, for instance by milling, in the side edge surfaces.

All side edge surfaces of the tile element may be provided with a coating layer. The provision of a coating layer having an outer and an inner coating layer on all side edge surfaces of the tile element makes it possible to provide sufficient rigidity of the tile element even if the porosity of the fibre material making up the tile element is high. For instance, the fibre material may be a mineral fibre material, such as glass wool, having a density in the range of 25-200 kg/m$^3$.

The coating layer may have a bending stiffness $EI_{cl}$ which is calculated as: $EI_{cl} \geq (T/40)^3 \times 60 \times 10E5$ (Nmm$^2$). T is the thickness of the tile element and may be in the range of 15-50 mm.

The outer coating layer may have a thickness of at least 100 μm and may be in the range of 100-1500 μm. The inner coating layer may have a penetration depth of at least 100 μm and may be in the range of 100-4000 μm.

The coating layer may have a dry surface density in the range of 180-1280 g/m$^2$. By "dry surface density" is meant surface density of the applied coating layer as measured after drying of the coating material.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
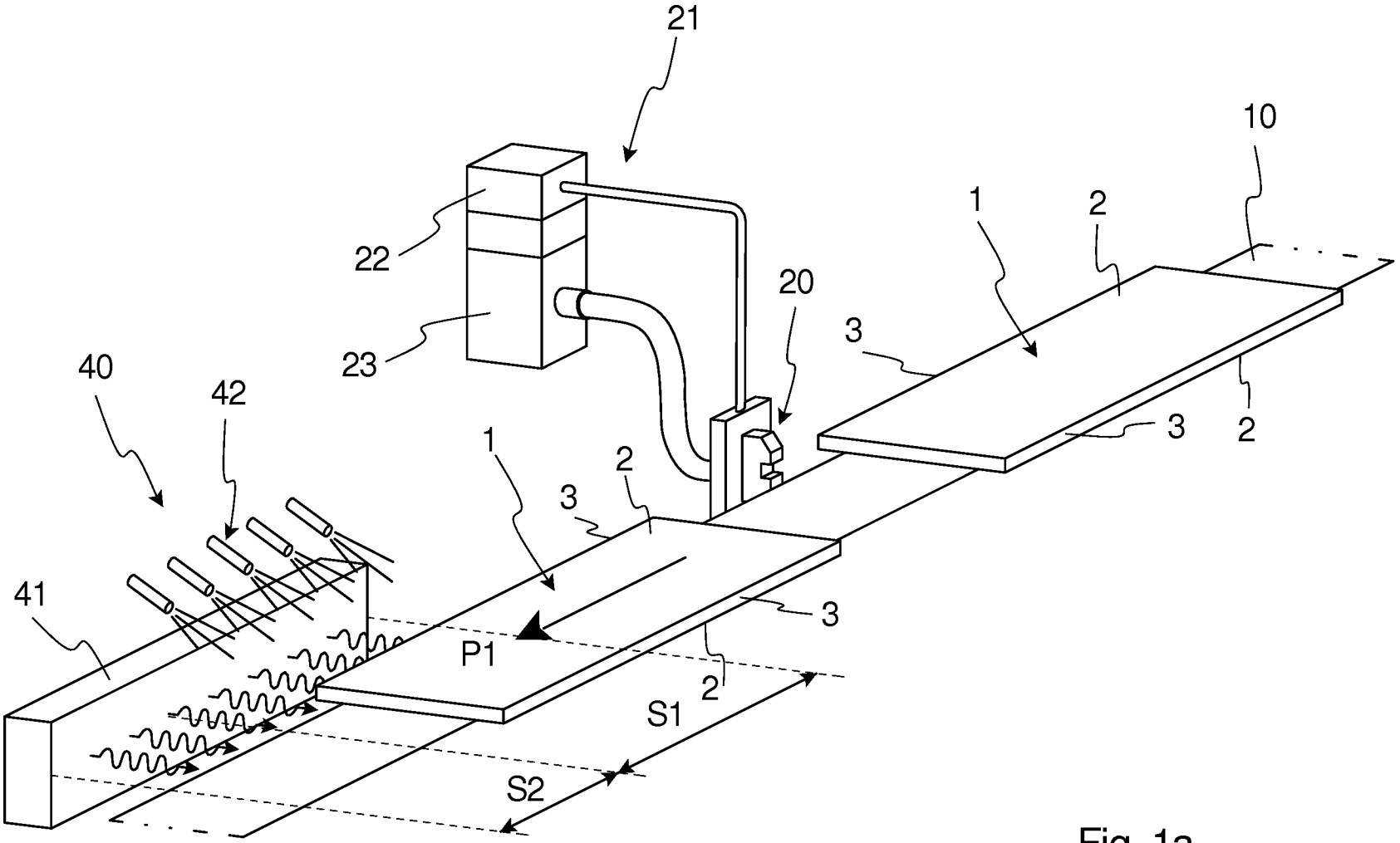
FIGS. 1 *a, b* are schematic perspective views illustrating the process of applying a water-based coating material to a side edge surface of a tile element according to an embodiment of the present invention.
Figure 1B:
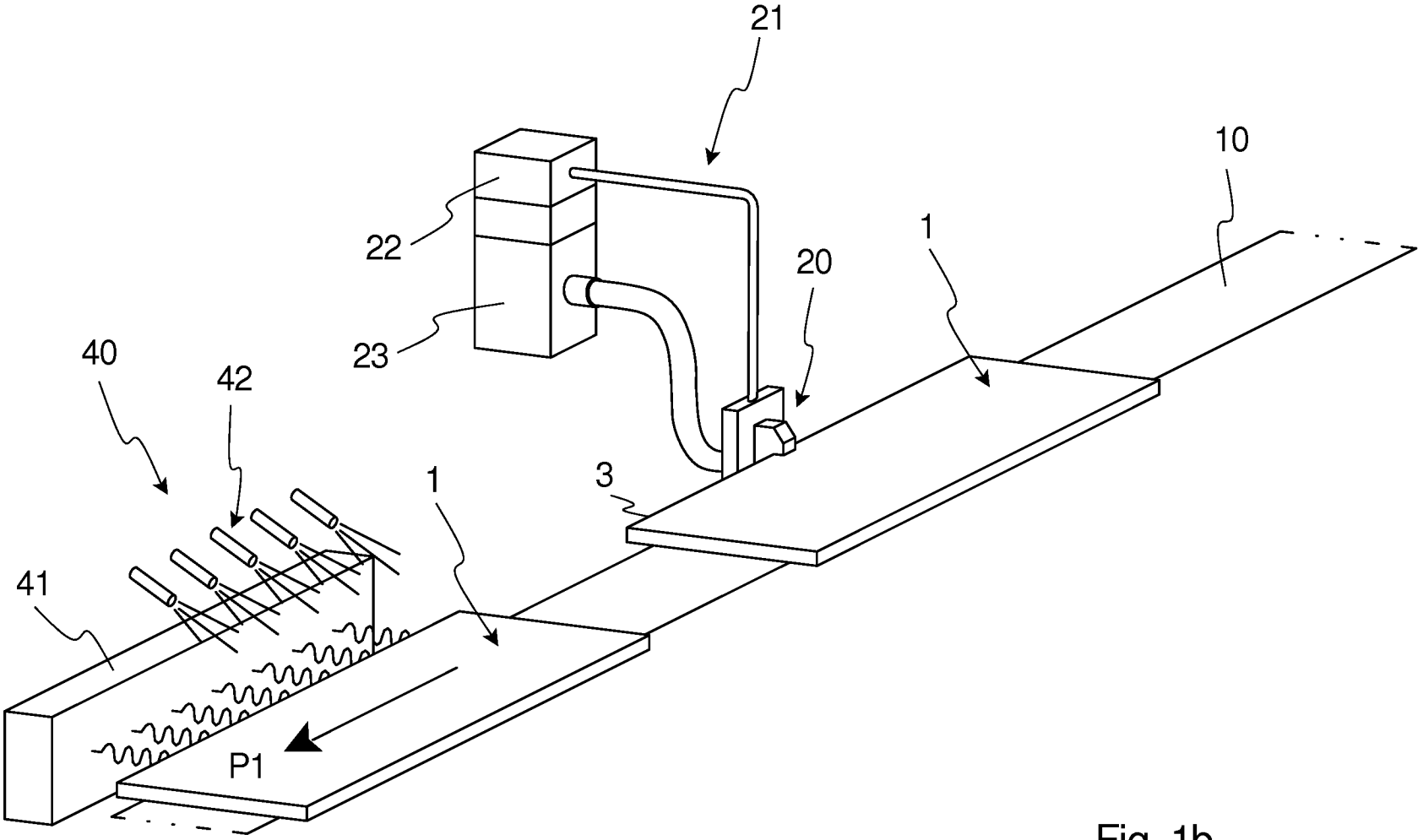

FIGS. 1*a* and 1*b*, to which reference now is made, illustrates a tile element 1 being conveyed on a conveyor belt 10 in the direction indicated by arrow P1. The tile element 1 may be conveyed at a feeding rate in the range of 25-150 m/min.

The tile element 1 is made of a porous compressed fiber material, such as glass wool or stone wool.

The porosity Ø, or the void fraction, of a material is a measurement of the empty space in a material and is calculated as the relationship between the volume of the void $V_V$, i.e. the empty space in the material, and the total volume of the material $V_T$:

$$Ø=V_V/V_T$$

The porosity is thus a fraction between 0 and 1 and may also be represented in percent by multiplying the fraction by 100.

In accordance with the present invention, a tile element 1 made of a porous compressed fiber material is provided having a porosity in the range of 0.92-0.99, i.e. having a high porosity.

The porous fiber material of the tile elementl 1 is compressed. For instance, a compressed glass wool material may be used having a density in the range of 25-200 kg/m$^3$. Glass has density of about 2500 kg/m$^3$, and thus a density of 25 kg/m$^3$ in a tile element made of a compressed glass wool material would correspond to a porosity of 0.99 and a density of 200 kg/m$^3$ would correspond to a porosity of 0.92.

The tile element 1 comprises two opposite major surfaces 2 and at least one side edge surface 3 extending between the two opposite major surfaces 2. In the shown embodiment, the tile element 1 has a rectangular shape, and thus there are four side edge surfaces 3 extending between the two opposite major surfaces 2. It is understood that other tile element shapes are feasible, such as a circular or triangular shape.

The side edge surfaces 3 may have a simple straight profile as in the shown embodiment, or a more complex profile for instance comprising one or more grooves and/or protruding tongues.

At least one of the major surfaces of the tile element may be provided with a front layer, such as a fabric, veil, mat or tissue. The front layer may be coated.

The finished tile element is to be included in a tile system and may be used as a horizontally arranged ceiling tile, a vertically arranged baffle element, a wall mounted element or a free standing screen.

According to the present invention, a water-based coating material is applied to at least one of the side edge surfaces 3 of the tile element 2.

The water-based coating is applied by means of an applicator head 20 of a continuous vacuum coating apparatus 21. In the shown embodiment, the continuous vacuum coating apparatus 21 is stationary arranged, and the tile element 1 is moved relative the applicator head 20 of the continuous vacuum coating apparatus 21 by means of the movement of the conveyor belt 10 at a relative feeding rate of at least 25 m/min and may be in the range of 25-150 m/min. It is of course also possible to achieve the relative feeding rate by movement of the applicator head relative a stationary arranged tile element or by simultaneous movement of both the applicator head and the tile element.

The applicator head 20 of the continuous vacuum coating apparatus 21 is configured to apply the water-based coating to the side edge surface 3 of the tile element 1 and to remove excess of the water-based coating through vacuum.

Figure 2:
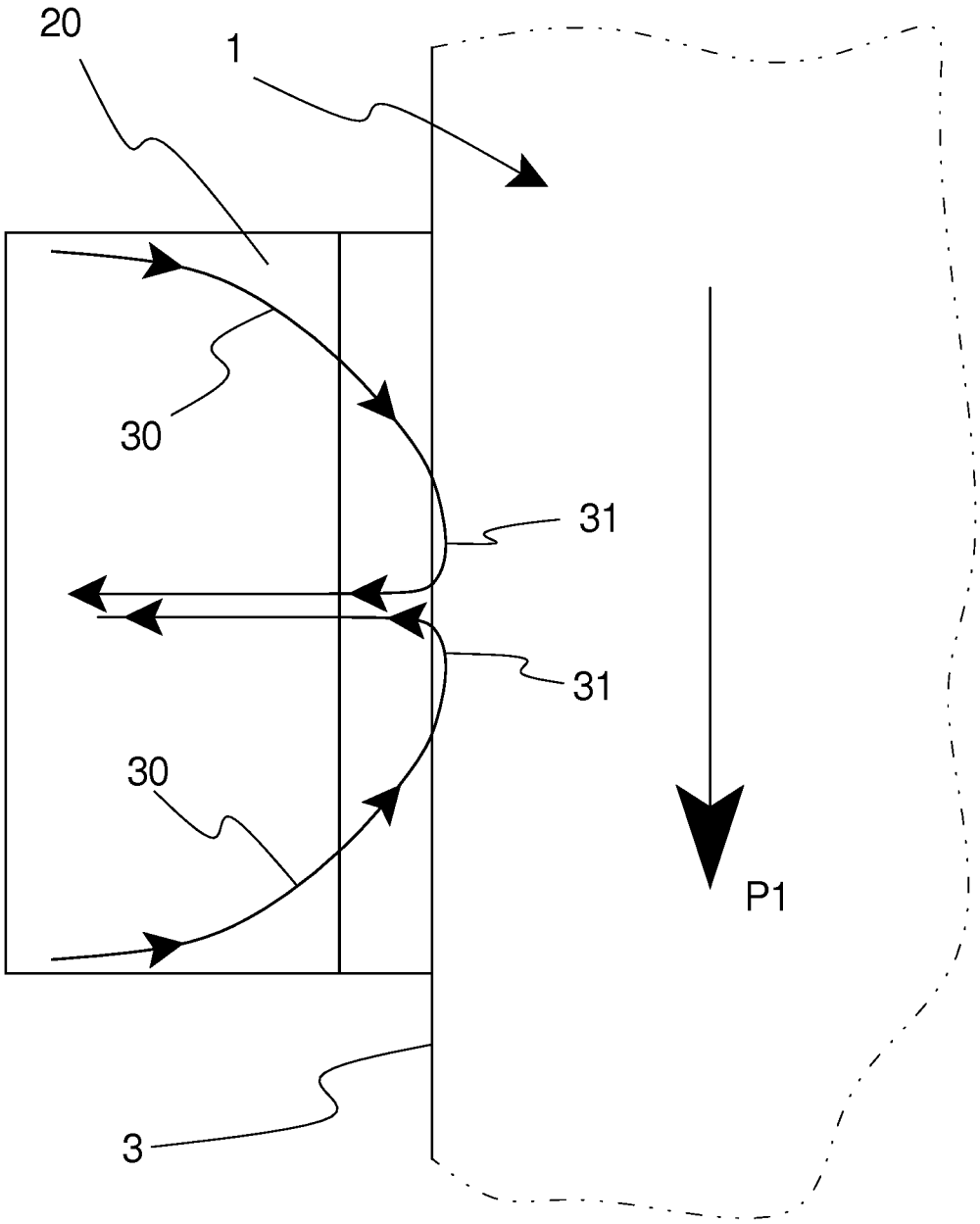
FIG. 2 is a schematic side view of an applicator head of a continuous vacuum coating apparatus during operation.

In FIG. 2, to which reference now also is made, is a schematic illustration from above of the applicator head 20 of the continuous vacuum coating apparatus 21 during operation, i.e. during application of the water-based coating material to the side edge surface 3 of the tile element 1.

The continuous vacuum coating apparatus 21 according to the shown embodiment comprises means 22 for directing two flows 30 of the water-based coating material into the applicator head 20, towards the side edge surface 3 of the tile element 1. The continuous vacuum coating apparatus 21 further comprises means 23 for creating a vacuum or a negative pressure causing each flow 30 of water-based coating material to deflect and to be sucked back into the continuous vacuum coating apparatus 21.

The side edge surface 3 of the tile element 1 is so positioned relative the applicator head 20 of the continuous vacuum coating apparatus 21 such that it engages a crest 31 formed by each flow 30 of coating material. Some of the water-based coating material will be applied to the side edge surface 3 while the excess coating material will be sucked back into the continuous vacuum coating apparatus 21 and be recirculated.

It is understood that the applicator head may have different configurations. For instance, the applicator head may be configured to apply the water-based coating material to a side edge surface comprising grooves and/or tongues.

After application of the water-based coating material to the side edge surface 3, the tile element 1 is transported to a drying section 40.

The drying section 40 may be arranged for drying the water-based coating applied to the side edge surface 3 by means of IR-radiation. The drying section shown in FIGS. 1*a, b* thus comprises IR-radiation means 41. Alternatively, the drying section may comprise micro wave radiation means or hot air means or a combination of IR-radiation means and/or micro wave radiation means and/or hot air means.

The drying section may, as shown in FIGS. 1*a, b*, have a longitudinal extension, wherein the IR-radiation means 41 and also steam generating means 42 are arranged at a first part S1 of the drying section 40 and wherein only the IR-radiation means 42 is arranged at a second part S2 of the drying section 40, the second part S2 being arranged downstream of the first part S1. Hereby it may be ensured that the drying of the applied water-based coating material is controlled such that a coating layer formed by the applied coating material dries from inside and out.

The tile element 1 may be kept in the drying section 40 for a period in the range of 8-45 s. In case the drying is performed by IR-radiation means, the time period range for drying may be 20-45 s, and in case the drying is performed by micro wave radiation means, the time period range for drying may be 8-20 s.

Figure 3:
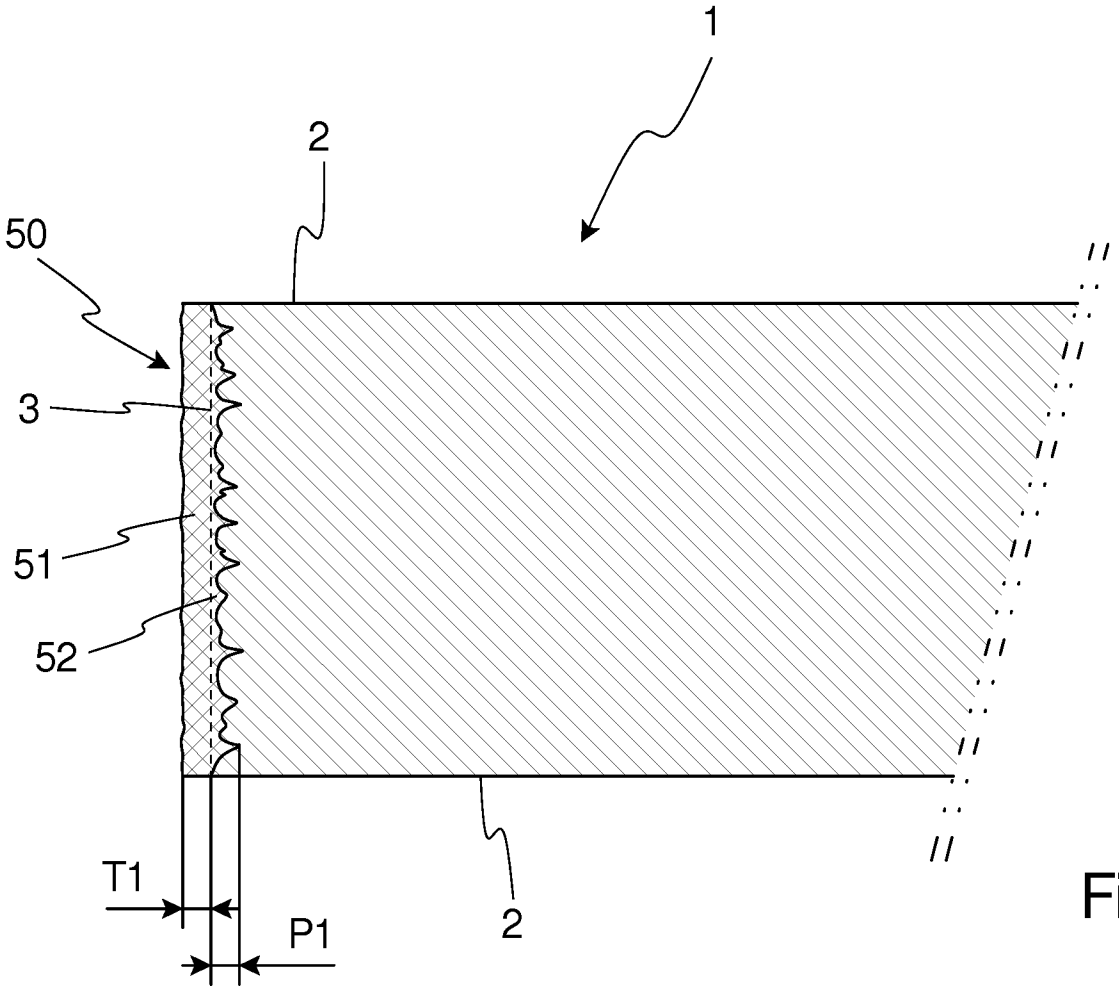
FIG. 3 is a cross sectional view of a side edge section of a tile element.

FIG. 3 discloses a cross-sectional of a part of a tile element 1 after drying of the water-based coating material applied to the side edge surface 3 of the tile element 1. The applied water-based coating material forms a coating layer 50 comprising an outer coating layer 51 and an inner coating layer 52.

The outer coating layer 51 corresponds to the part of the coating layer 50 that extends beyond the side edge surface 3 itself (indicated by a dotted line) of the tile element 1, and may have thickness T1 of at least 100 μm and may be in the range of 100-1500 μm.

The inner coating 52 layer corresponds to the part of the coating layer 50 that due to the application method of the water-based coating material and the porosity of the compressed fibre material making up the tile element 1 penetrates the side edge surface 3 and extends into the tile element 1. The inner coating layer 52 has a penetration depth P1 of at least 100 μm and may be in the range of 100-4000 μm.

The water-based coating material may be applied with wet surface density in the range of 300-1600 g/m$^2$.

The thickness T1 of the outer coating layer 51 may have a non-uniform configuration.

The penetration depth P1 of the inner coating layer 52 will due to the application method and porosity of the porous fibre material be non-uniform, as clearly illustrated in FIG. 3. The average penetration depth may be in the range of 0.2-1.5 mm.

It is understood that the water-based coating material may be applied to all side edge surfaces 3 of the tile element 1. By using a water-based coating material which after application and drying forms a coating layer 50 with sufficient mechanical strength, it may hereby be possible to achieve a reinforcing frame structure enclosing the tile element 1, also referred to as edge-banding, improving the structural integrity of the tile element 1. The edge-banding effect may enable making the tile element of a porous fiber material with high porosity, such as glass wool of a relative low density, without having problems normally associated with low density, such as sagging.

By using a water-based coating which after application and drying forms a coating layer 50 with sufficient mechanical strength, it may also be possible to subsequently form grooves and the like in the side edge surface 3 of the tile element 1 even if it is made of a fibre material having a high porosity. The reason for this is that the inner coating layer 52 of the coating layer 50 may reinforce the side edge surface 3 in which the grooves and the like is to be formed.

The mechanical strength of the coating layer 50 is dependent of the coating material used for forming the coating layer, the porosity of the fibre material of the tile element 1 and the amount of applied coating material, i.e. the surface density of the coating material. It is believed that it is the structure of the continuous vacuum coating apparatus applied coating layer 50 comprising an outer and an inner coating layer which enables the coating layer 50 to exhibit a relative high bending stiffness even for relatively moderate surface densities. Thus, the coating layer 50 applied to the side edge surface 3 of the inventive tile element 1 exhibits an improved mechanical strength.

According to the present invention, the characteristics of the coating material, the porosity of the fibre material and the surface density may be so selected that the coating layer 50 has a bending stiffness $EI_{cl}$ of at least 60×10E5 Nmm$^2$ when applied to a planar side edge of a tile element having a thickness of 40 mm.

Figure 4A:
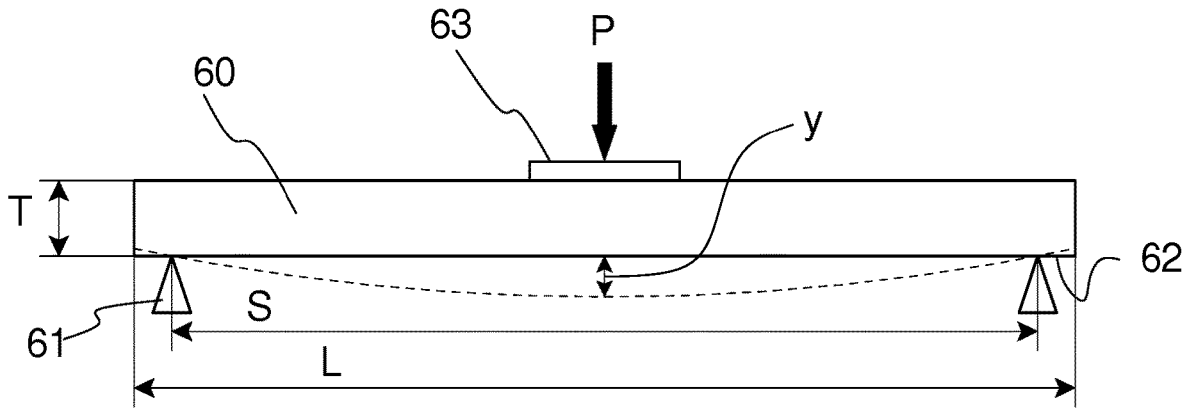
FIG. 4*a* is a schematic side view illustrating a three-point flexural bending test set up for determination of the bending stiffness $EI_{cl}$ for a continuous vacuum coating apparatus applied coating layer.
Figure 4B:
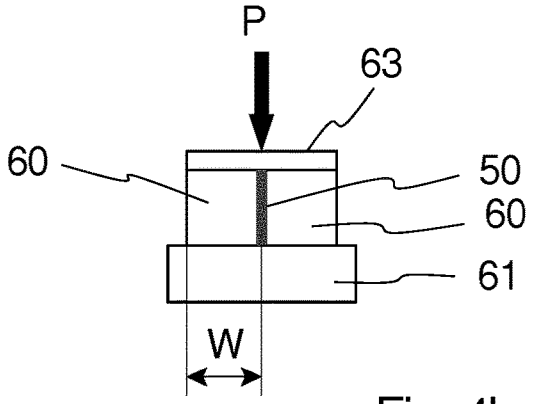
FIG. 4*b* is a schematic end view of the three-point flexural bending test set up shown in FIG. 4*a*.

The bending stiffness $EI_{cl}$ of the coating layer may be measured in a three-point flexural bending test, which will be described below with reference to FIGS. 4*a* and 4*b*.

Two test sections 60 are cut from opposite sides of a tile element having a continuous vacuum coating apparatus applied coating layer 50 on its planar side edges.

The two sections 60 are placed together with the side edges having the continuous vacuum coating apparatus applied coating layers 50 facing each other. By this configuration instability phenomenon such as twisting and buckling is avoided or at least limited during the test. The surface that is supposed to face the room of the tile element is defined as the underside 62 of the test sections 60.

The two sections 60 form a test specimen having a cross section of 2×W×T (where W is the width of the test specimen and T is the thickness of the test specimen).

The test specimen is placed on two supports 61 as a simply supported beam with the underside 62 facing downwards. The supports 61 has a span S.

A load spreading membrane 63 may be placed on top of the test specimen at the mid of the span S and used in order to distribute load so that local "compression deformation" of the upper part of the test specimen is avoided.

A load P is applied at the mid of the span S. The downward deflection y of the test specimen is measured at the center of the span S.

The load P is increased until a deflection of a least 10% of the thickness T of the test specimen is achieved.

The bending stiffness ($EI_{sp}$) of the test specimen is subsequently calculated as $$EI_{sp}=(P\times L^3)/(48\times y).$$

The bending stiffness ($EI_{cl}$) for a single coating layer may finally be calculated as $$EI_{cl}=(EI_{sp}-EI_{ref})/2,$$

where $EI_{ref}$ is the stiffness of a test specimen without any coating layer on the side edges.

In practical tests, the planar side edges of tile elements having a thickness of 40 mm were provided with continuous vacuum coating apparatus applied coating layers. For a tile element having a compressed fibre material density of 27 kg/m$^3$, the coating material was applied with a wet surface density of about 1050 g/m$^2$ and for a tile element having a compressed fibre material density of 54 kg/m$^3$, the coating material was applied with a wet surface density of about 620 g/m$^2$. Test sections were cut from the tile elements, each test section having a width W of 50 mm, a thickness T of 40 mm and a length L of 550 mm. Test specimens formed from the test sections were placed supports 61 having a span S of 500 mm. The resulting bending stiffness Eli of the coating layer applied to the tile element having a compressed fibre material density of 27 kg/m$^3$ was 60×10E5 Nmm$^2$. The bending stiffness $EI_{cl}$ of the coating layer applied to the tile element having a compressed fibre material density of 54 kg/m$^3$ was about 70×10E5 Nmm$^2$.

As mentioned above, according to the present invention, the coating layer has a bending stiffness $EI_{cl}$ of at least 60×10E5 Nmm$^2$ when applied to a planar side edge of a tile element having a thickness T of 40 mm (corresponding to the length of the coating layer as measured in a normal direction to the major surfaces of the tile element). If the thickness of the tile element is different, the bending stiffness $EI_{cl}$ of coating layer may be calculated as $$EI_{cl}\geq(T/40)^3\times 60\times 10E5$$

where T is thickness (in mm) of the tile element.

The water-based coating material used in this invention may comprise at least one binder resin, fillers/pigments, solvent/diluent, and additives.

Water is used as the main solvent/diluent.

As binder resins, polymers may be used, such as those selected from acrylics, polyesters, polyurethanes, alkyds and mixtures or hybrids thereof. The binder resin is preferably used in the form a water-borne resin dispersion.

Fillers, for example, calcium carbonate, talc, dolomite, or clay may be used as fillers in the coating material. $TiO_2$ and/or ZnO are suitable inorganic pigments, but also carbon black and organic pigments can be used, depending on the desired color of the coating composition.

Various additives can be used to provide for optimal physical characteristics of the coating material. These may include viscosity modifiers (such as urethane, acrylic, and cellulosic thickeners), defoamers (such as defoamers based on silicon oil or mineral oil), matting agents (such as silica, as well as micronized waxes of e.g. polyethylene, polypropylene, polyethylene terephthalate, and polytetrafluoroethylene), dispersing agents (such as charged polymers, block copolymers, and surfactants), surface wetting agents (such as siloxanes, gemini surfactants, and fluorosurfactants), and in-can biocides.

The coating material may be manufactured in a conventional way known by people skilled in the art of paint manufacturing—for example, by mixing all the ingredients using mixing equipment.

For optimal application properties, the coating material may have a viscosity in the range 50-200 Krebs unit (KU) (about 0.15-11.27 kg/m/s), more preferably in the range 80-160 KU (about 0.87-6.46 kg/m/s) and most preferably in the range of 105-115 KU (about 2.04-2.65 kg/m/s). The viscosity can be measured using a viscometer of Stormer-type according to ASTM D562.

Other technical parameters for the coating material for the application in the present invention are a dry content of at least 60 wt. % and may be in the range of 60-80 wt. %, a density in the range 1.0-1.4 g/cm$^3$, a pigment volume concentration (PVC) of 30-70 wt. %, and a volatile organic compounds (VOC) content of less than 30 g/l, more preferably less than 15 g/l.

The water-based coating material may comprise at least one of the following components: a coloring component such as a pigment, a shine regulating component, a UV-resistance promoting component, a mould growth inhibiting component, a fire resistance promoting component.

It will be appreciated that the present invention is not limited to the embodiments shown. Several modifications and variations are thus conceivable within the scope of the invention which thus is exclusively defined by the appended claims.

The invention claimed is:

1. A method for coating a tile element, the method comprising:

providing a tile element made of a compressed fiber material having a porosity in in a range of from 0.92 to 0.99, the tile element having two opposite major surfaces; and applying a water-based coating material to a side edge surface of the tile element extending between the two opposite major surfaces, wherein the applying the water-based coating material is performed by an applicator head of a continuous vacuum coating apparatus, the applicator head being configured to apply the water-based coating material to the side edge surface of the tile element and to remove excess of the water-based coating material through a vacuum, wherein the water-based coating material is applied at a feeding rate of the tile element relative the applicator head of the continuous vacuum coating apparatus in a range of from 50 to 150 m/min, wherein the water-based coating material is applied to the side edge surface such that a coating layer is formed comprising an outer coating layer extending beyond the side edge surface and an inner coating layer penetrating the side edge surface and extending into the tile element, and wherein the inner coating layer is given a penetration depth of at least 100 μm.

2. The method of claim 1, wherein the penetration depth of the inner coating layer is in a range of from 100 to 4000 μm.

3. The method of claim 1, wherein the water-based coating material is applied to all side edge surfaces extending between the two major surfaces of the tile element.

4. The method of claim 1, further comprising:

drying the applied water-based coating material by IR-radiation and/or micro wave radiation.

5. The method of claim 1, wherein the outer coating layer is given a thickness of at least 100 μm.

6. The method of claim 5, wherein the thickness of the outer coating layer is in a range of from 100 to 1500 μm.

7. The method of claim 1, wherein the water-based coating material is applied to the side edge surface with a wet surface density in a range of from 300 to 1600 g/m$^2$.

8. The method according to claim 1, wherein the water-based coating material has an operational viscosity in a range of from 50 to 200 Krebs unit (KU).

9. The method of claim 1, wherein the water-based coating material has an operational viscosity in a range of from 80 to 160 KU.

10. The method of claim 1, wherein the water-based coating material has an operational viscosity in a range of from 105 to 115 KU.

11. The method of claim 1, wherein the water-based coating material has a dry content of at least 60 wt. %.

12. The method of claim 11, wherein the dry content of the water-based coating material is in a range of from 60 to 80 wt. %.

13. The method of claim 1, wherein the compressed fiber material is a compressed mineral fiber material having a density in a range of from 25 to 200 kg/m$^3$.

* * * * *